US011841166B2

(12) United States Patent
Chau

(10) Patent No.: US 11,841,166 B2
(45) Date of Patent: Dec. 12, 2023

(54) SEMICONDUCTOR REFRIGERATION AND HEATING AIR CONDITIONER

(71) Applicant: Siu Tai Chau, Hong Kong (HK)

(72) Inventor: Siu Tai Chau, Hong Kong (HK)

( * ) Notice: Subject to any disclaimer, the term of this patent is extended or adjusted under 35 U.S.C. 154(b) by 614 days.

(21) Appl. No.: 16/346,142

(22) PCT Filed: Dec. 4, 2018

(86) PCT No.: PCT/IB2018/059596

§ 371 (c)(1),
(2) Date: Apr. 30, 2019

(87) PCT Pub. No.: WO2019/116156

PCT Pub. Date: Jun. 20, 2019

(65) Prior Publication Data

US 2022/0003438 A1 Jan. 6, 2022

(30) Foreign Application Priority Data

Dec. 14, 2017 (HK) ..... 17113361.5

(51) Int. Cl.
*F24F 5/00* (2006.01)
*F24F 8/158* (2021.01)
(Continued)

(52) U.S. Cl.
CPC ..... *F24F 5/0042* (2013.01); *F24F 5/0035* (2013.01); *F24F 8/158* (2021.01);
(Continued)

(58) Field of Classification Search
CPC ..... F24F 5/0042; F24F 8/158; F24F 5/0035; F24F 13/082; F24F 13/222; F24F 2110/20; F24F 2110/10
See application file for complete search history.

(56) References Cited

U.S. PATENT DOCUMENTS 5,166,530 A * 11/1992 McCleary ..... G03F 7/2008 250/492.2
2012/0169067 A1* 7/2012 Ruan ..... F24H 4/06 290/1 R (Continued)

FOREIGN PATENT DOCUMENTS

CN 101514833 A * 8/2009
CN 101514833 A 8/2009

(Continued)

OTHER PUBLICATIONS

CN101514833A Translation (Year: 2008).*

(Continued)

*Primary Examiner* — Schyler S Sanks

(57) ABSTRACT

The present invention relates to a semiconductor refrigeration and heating air conditioner which includes a body with an air outlet and air inlets, and also includes a semiconductor refrigeration assembly mounted in the body and located at the air outlet, metallic conductive sheets connected with the semiconductor refrigeration assembly, a water tank mounted at the lower end inside the body, a cooling water receptacle mounted at the lower end inside the body, a heat dissipation assembly mounted in the cooling water receptacle, and fan blades mounted in the body and close to the air inlets, wherein the semiconductor refrigeration assembly is connected with the heat dissipation assembly through a connection wire, the metallic conductive sheets face the air outlet, and the water tank is connected with the cooling water receptacle through a water pump assembly.

20 Claims, 4 Drawing Sheets

(51) Int. Cl.

| | |
|---|---|
| ***F24F 13/08*** | (2006.01) |
| ***F24F 13/22*** | (2006.01) |
| ***F24F 110/20*** | (2018.01) |
| ***F24F 110/10*** | (2018.01) |

(52) U.S. Cl.
CPC ..... *F24F 13/082* (2013.01); *F24F 13/222* (2013.01); *F24F 2110/10* (2018.01); *F24F 2110/20* (2018.01)

(56) References Cited

U.S. PATENT DOCUMENTS

| | | | | |
|---|---|---|---|---|
| 2017/0122604 | A1* | 5/2017 | Song | F24F 11/30 |
| 2018/0023823 | A1* | 1/2018 | Chen | F25B 21/02 62/3.7 |
| 2018/0274802 | A1* | 9/2018 | Nishimura | F24F 13/02 |

FOREIGN PATENT DOCUMENTS

| | | | | |
|---|---|---|---|---|
| CN | 102818324 | A | 12/2012 | |
| FR | 3036457 | A3 * | 11/2016 | F16L 37/04 |

OTHER PUBLICATIONS

FR-3036457-A3 Translation (Year: 2016).*
International Search Report of PCT Patent Application No. PCT/IB2018/059596 dated Mar. 20, 2019.

* cited by examiner

SEMICONDUCTOR REFRIGERATION AND HEATING AIR CONDITIONER

TECHNICAL FIELD

The present invention relates to an air conditioner, and more especially, to a semiconductor refrigeration and heating air conditioner.

BACKGROUND ART

Every household in modern cities is accustomed to using evaporative air coolers. Reckoned according to Hong Kong's Electricity Consumption Data of the Census and Statistics Department in 2015, over 3 billion kWh (equivalent to 235,500-ton carbon emission) is consumed by air-conditioning equipment in residential houses only in one year. However, the heat dissipated by evaporative air coolers outdoors during refrigeration causes the outdoor air temperature to rise and intensifies the urban heat island effect in a disguised way, which has an unquantifiable impact on this aspect. As general household air coolers or electric fans are incapable of achieving desired cooling efficacy, users generally have to use evaporative air coolers. If a product that has a refrigeration or heating effect but consumes much less electricity than the evaporative air cooler is available for using as a substitute for the evaporative air cooler, it will be advantageous to save energy, reduce emissions and improve air quality.

Therefore, there is an urgent need for a semiconductor refrigeration and heating air conditioner.

SUMMARY

An object of the present invention is to provide a semiconductor refrigeration and heating air conditioner which does not dissipate heat outdoors and meets the demand for the refrigeration or heating effect by overcoming the above-mentioned deficiencies of the prior art.

The present invention provides a semiconductor refrigeration and heating air conditioner which comprises a body with an air outlet and air inlets, and also comprises a semiconductor refrigeration assembly mounted in the body and located at the air outlet, metallic conductive sheets connected with the semiconductor refrigeration assembly, a water tank mounted at the lower end inside the body, a cooling water receptacle mounted at the lower end inside the body, a heat dissipation assembly mounted in the cooling water receptacle, and fan blades mounted in the body and close to the air inlets, wherein the semiconductor refrigeration assembly is connected with the heat dissipation assembly through a connection wire, the metallic conductive sheets face the air outlet, and the water tank is connected with the cooling water receptacle through a water pump assembly.

In another aspect, the present invention provides a semiconductor refrigeration and heating air conditioner which comprises a body with an air outlet and air inlets, and also comprises a semiconductor refrigeration assembly mounted in the body and located at the air outlet, metallic conductive sheets connected with the semiconductor refrigeration assembly, a water tank mounted at the lower end inside the body, a cooling water receptacle surrounding the semiconductor refrigeration assembly and mounted to the heat generation end of the semiconductor refrigeration assembly, and fan blades mounted in the body and close to the air inlets, wherein the metallic conductive sheets face the air outlet, and the water tank is connected with the cooling water receptacle through a water pump assembly.

Further, the case of the cooling water receptacle is made of metal and attached to the heat generation end of the semiconductor refrigeration assembly, and the case is in direct contact with the heat generation end of the semiconductor refrigeration assembly.

Further, vertical wind direction guide plates and horizontal wind direction guide plates are mounted in turn from outside to inside at the air outlet.

Further, the air conditioner also comprises a first temperature and humidity sensors mounted in the body, wherein the first temperature and humidity sensors are located between the horizontal wind direction guide plates and the metallic conductive sheets.

Further, the air conditioner also comprises a plasma releaser and an ultrasonic moisture releasing device, wherein the plasma releaser and the ultrasonic moisture releasing device are mounted in the body and close to backs of the metallic conductive sheets, and the ultrasonic moisture releasing device is connected with the water pump assembly through a connection pipe.

Further, the air outlet is made in the front of the body, there are two air inlets which are made in two sides of the body respectively, and there are two fan blades which are mounted on two sides in the body respectively, wherein each fan blade faces one air inlet.

Further, a dust separating screen, a HEPA (high efficiency particulate air) filter screen and an activated carbon filter screen are mounted in turn from outside to inside at each air inlet. The dust separating screen covers the entire outer end of the air inlet, and the activated carbon filter screen is aligned with the HEPA filter screen.

Further, a movable door is also set at each air inlet, wherein the movable door is located on one side of the HEPA filter screen.

Further, the air conditioner also comprises two sets of second temperature and humidity sensors mounted on two sides in the body, wherein the two sets of second temperature and humidity sensors are located between the fan blade and the activated carbon filter screen on the corresponding side.

Further, the air conditioner also comprises a dew receptacle mounted under the metallic conductive sheets, wherein the dew containing is connected with the water tank through a return pipe.

Further, the semiconductor refrigeration assembly comprises a plurality of semiconductor refrigeration elements mounted at the upper end of the air outlet and on two sides of the air outlet. The metallic conductive sheets are located in a space surrounded by the plurality of semiconductor refrigeration elements and are connected with the plurality of semiconductor refrigeration elements respectively.

The present invention makes use of the semiconductor refrigeration assembly to achieve indoor cooling or heating effect with less electricity to be consumed. Cooling water is used to cool the heat dissipation assembly of the semiconductor refrigeration assembly in the body, which saves the need to dissipate heat outdoors. It does not cause the outdoor air temperature to rise or intensify the heat island effect. It also reduces damages to the environment, thereby being energy-efficient and environmentally-friendly.

DETAILED DESCRIPTION

The present invention will be further described hereafter in combination with embodiments and the accompanying drawings.

Figure 1:
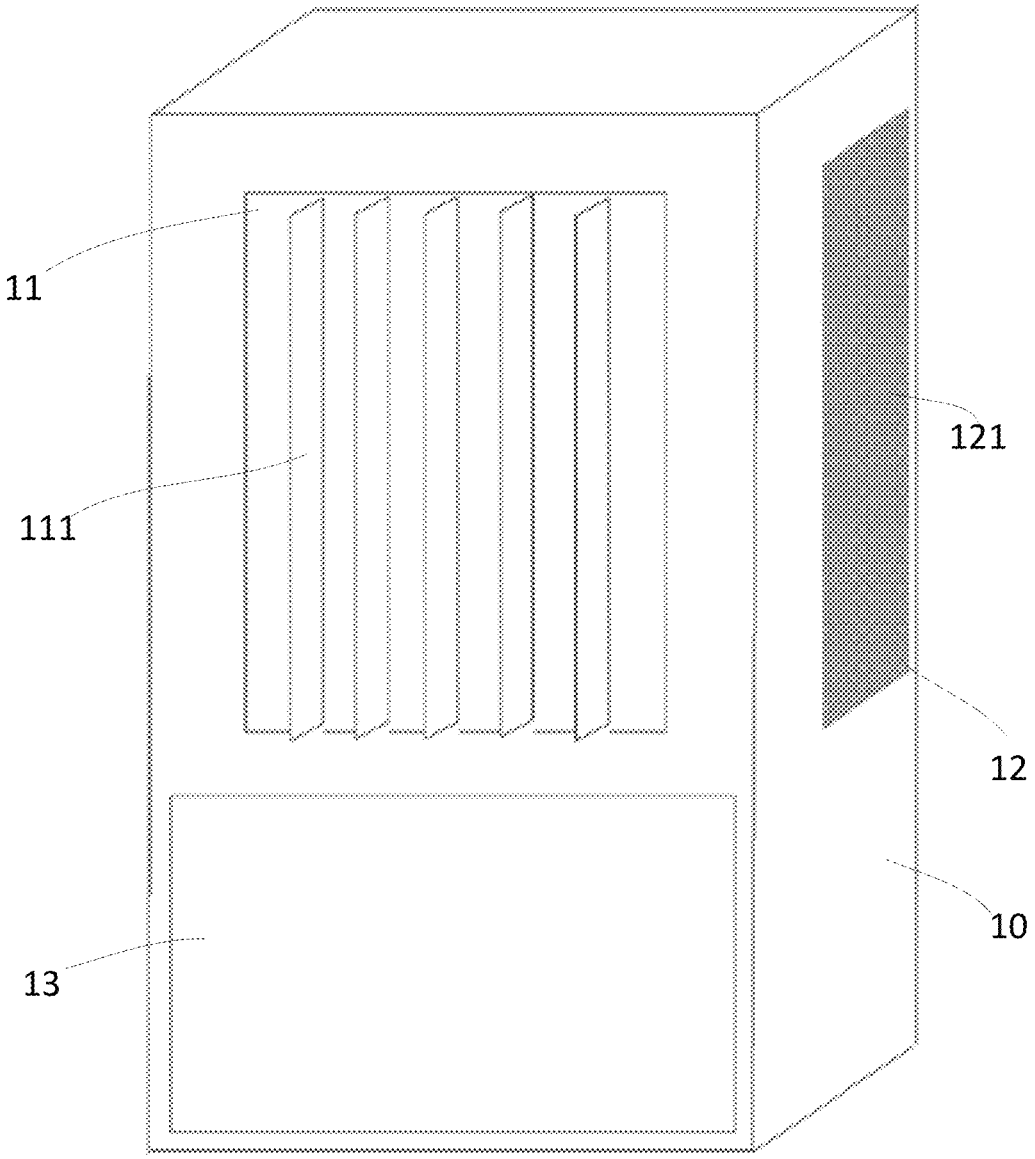
FIG. 1 is a schematic view of a semiconductor refrigeration and heating air conditioner provided by an embodiment of the present invention.
Figure 2:
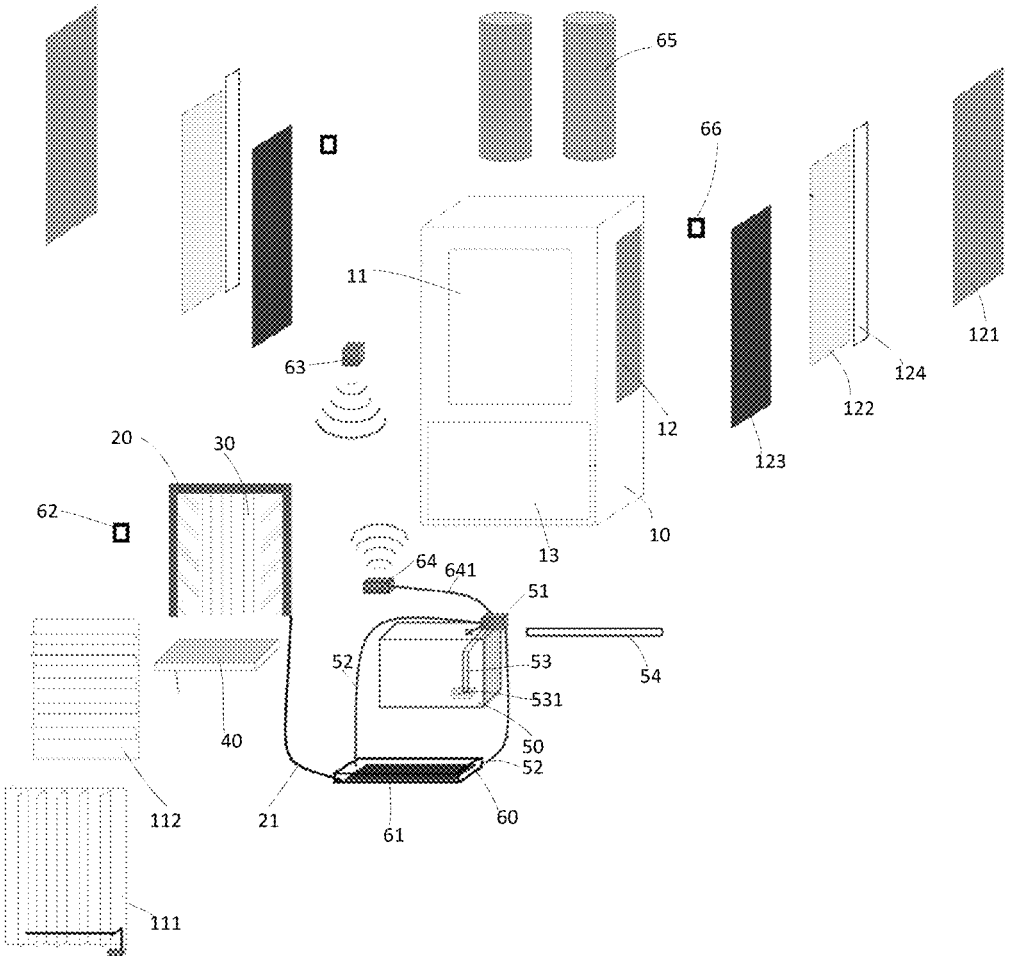
FIG. 2 is a schematic exploded view of the semiconductor refrigeration and heating air conditioner shown in FIG. 1.
Figure 3:
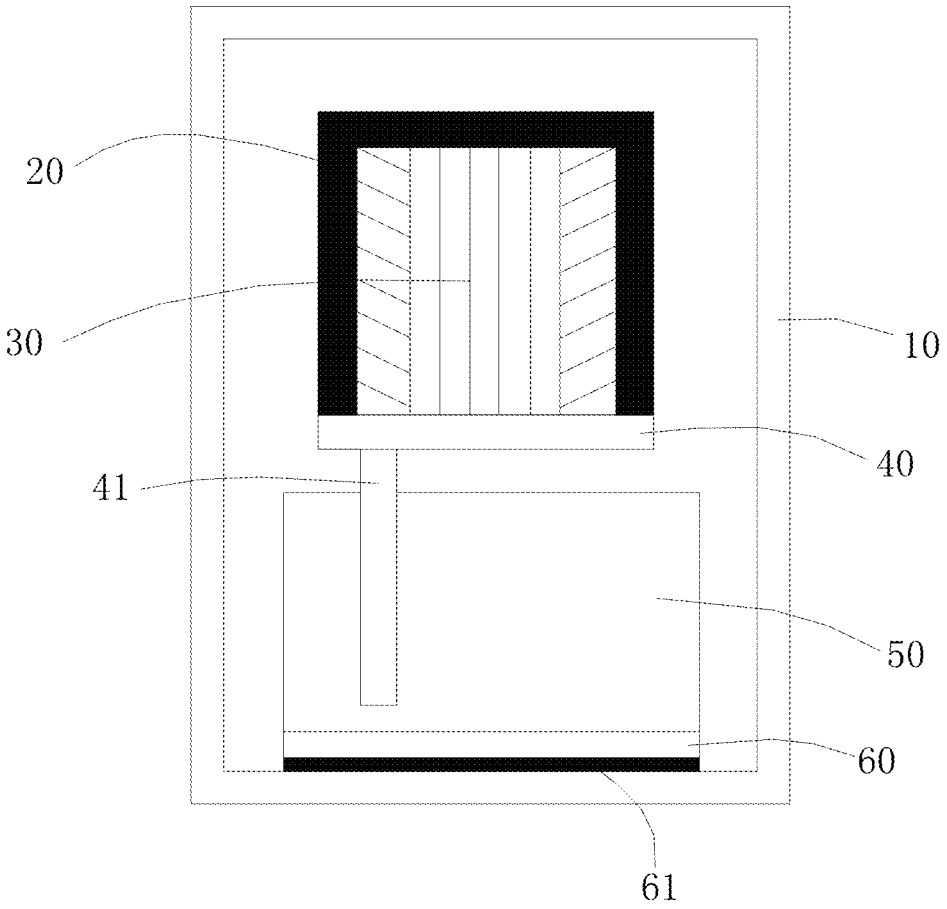
FIG. 3 is a schematic view of the interior of the front of the semiconductor refrigeration and heating air conditioner shown in FIG. 1.

With reference to FIGS. 1, 2 and 3, a semiconductor refrigeration and heating air conditioner provided by the present invention comprises a body 10, a semiconductor refrigeration assembly 20, metallic conductive sheets 30 connected to the semiconductor refrigeration assembly 20, a dew receptacle 40 mounted under the metallic conductive sheets 30, a water tank 50, a cooling water receptacle 60, a heat dissipation assembly 61 mounted in the cooling water receptacle 60, and two fan blades 65. The semiconductor refrigeration assembly 20 is connected with the heat dissipation assembly 61 through a connection wire 21 so as to dissipate heat through the heat dissipation assembly 61.

An air outlet 11 is made in the upper end of the front of the body 10, and a movable door 13 which may be manually opened is set in the lower end of the front of the body. An air inlet 12 is made in each side of the body 10. Both the air outlet 11 and the air inlets 12 are in the shape of a rectangle. Air enters through the air inlets 12 in the two sides of the body 10 under the action of the fan blades 65, and after refrigerated or heated by the semiconductor refrigeration assembly 20, comes out through the air outlet 11 in the front of the body 10. Compared with a conventional fan in which a space has to be reserved for air intake in the back of the body 10, the body 10 of the present invention may be placed against a wall completely, which saves space, enhances the convection effect of the indoor air, and allows cool wind and clean air to more evenly flow into each corner of a room.

The semiconductor refrigeration assembly 20 is mounted at the air outlet 11 inside the body 10 to refrigerate the air flowing through it to provide a cooling effect or heat the same to provide a heating effect, and also to achieve a dehumidification effect by utilizing the characteristic of temperature difference of the air. The semiconductor refrigeration assembly 20 may comprise two sets of refrigeration/heating units which may be separately activated. During dehumidification, the two sets of refrigeration/heating units in front and in rear may be used for front refrigeration and back heating simultaneously or front heating and back refrigeration simultaneously, to achieve a dehumidification effect under the action of temperature difference. During dehumidification, first heating and then refrigeration or first refrigeration and then heating may be selected as an air-out mode according to the room temperature. The air-out mode of first heating and then refrigeration is conducive to enhancing the dehumidification efficacy at a low temperature, while that of first refrigeration and then heating is conducive to enhancing the drying efficacy. Less electricity is consumed and carbon emissions are reduced when the semiconductor refrigeration assembly 20 is used to refrigerate or heat a room, which is environmentally-friendly and energy-efficient. The semiconductor refrigeration assembly 20 may achieve a freezing effect of below 6□, and can provide a long-term and stable refrigeration effect without making a noise during refrigeration or heating, thereby providing a cosier environment for users. Besides, the refrigeration temperature of the semiconductor refrigeration assembly 20 is not lower than the freezing point, so no defrosting is required in dehumidification.

Preferably, the semiconductor refrigeration assembly 20 comprises a plurality of semiconductor refrigeration elements mounted at the upper end of the air outlet 11 and on two sides of the air outlet 11. The metallic conductive sheets 30 are located in a space surrounded by the plurality of semiconductor refrigeration elements and connected with the plurality of semiconductor refrigeration elements, respectively. In refrigeration or heating, the heat of the plurality of semiconductor refrigeration elements may be conducted by the metal conductive sheets 30.

The metallic conductive sheets 30, facing the air outlet 11, may increase the contact area with the air flowing through them to enhance the efficacy of air refrigeration or heating. The metallic conductive sheets 30 are capable of keeping the refrigeration or heating temperature for a long period of time. Even though the semiconductor refrigeration assembly 20 has stopped refrigeration or heating, the air flowing through it is still refrigerated or heated for a period of time to maintain the refrigeration or heating effect. Therefore, the semiconductor refrigeration assembly 20 may be designed to start up intermittently, thus achieving the energy-saving effect.

A dew receptacle 40 is mounted under the metallic conductive sheets 30, so that when the air conditioner refrigerates or dehumidifies the air, the moisture in the air condenses on the metallic conductive sheets 30 as the air flows through the metallic conductive sheets 30, and condensed water flows into the dew receptacle 40 under gravity to collect condensed water.

A water tank 50 and a cooling water receptacle 60 are mounted at the lower end inside the body 10. In this embodiment, the cooling water receptacle 60 is located at the bottom inside the body 10, and the water tank 50 is mounted at the upper end of the cooling water receptacle 60. The water tank 50 is used for storing cooling water to cool the heat dissipation assembly 61 so as to ensure the refrigeration or heating efficacy of the semiconductor refrigeration assembly 20. The water tank 50 faces the movable door 13 which is set in the lower end of the front of the body 10. To further enhance the cooling effect, it is required to open the movable door 13, inject icy water into the water tank 50 or place ice that has been frozen in an icebox into the water tank 50. The dew receptacle 40 is connected with the water tank 50 through a return pipe 41, so the water condensed on the metallic conductive sheets 30 may flow into the water tank 50 through the return pipe 41, which is energy-efficient and environmentally-friendly.

In other embodiments, optionally, both the water tank 50 and the cooling water receptacle 60 are mounted at the bottom in the body 10, and the water tank 50 is close to the movable door 13, which can also achieve the foregoing technical effects.

The back of the water tank 50 is mounted with a UV sterilization device 54 which is intended for disinfecting and sterilizing cooling water in the water tank 50 with ultraviolet so as to prevent pathogens from accumulating in the water tank 50. Preferably, the UV sterilization device 54 is a UV tube.

The water tank 50 is connected with the cooling water receptacle 60 through a water pump assembly. Specifically, the water pump assembly comprises a pump 51 mounted at the top of the water tank 50, a first pipe 53 and second pipes 52 connected with the pump 51. The first pipe 53 is located in the water tank 50, and an end of the first pipe 53 is provided with a filter screen 531 to separate impurities and the like out of water, so that the components are more durable and the service life is longer. The second pipes 52 are connected with the cooling water receptacle 60, and preferably, there are two second pipes 52. The cooling water in the water tank 50 flows into the cooling water receptacle 60 through the first pipe 53 and the second pipes 52 under the action of the pump 51 so as to cool the heat dissipation assembly 61 in the cooling water receptacle 60, and after heat exchange, the water flows into the water tank 50 through the second pipes 52 and the first pipe 53 under the action of the pump 51. The cycle is repeated in such a way to achieve the cooling effect of the heat dissipation assembly 61. With this design, the heat dissipation assembly 61 does not need to dissipate heat and cool itself outdoors, and hence will not cause the outdoor air temperature to rise.

The two fan blades 65 are mounted on two sides in the body 10, and each of the fan blades 65 is close to and faces one air inlet 12. The fan blades 65 are intended to suck in the indoor air through the air inlets 12 and expel sucked-in air out of the body 10 through the air outlet 11. The rotation speed of the fan blades 65 can be adjusted according to actual conditions.

In this embodiment, vertical wind direction guide plates 111 and horizontal wind direction guide plates 112 are mounted in turn from outside to inside at the air outlet 11. The horizontal wind direction guide plates 112 may swing right and left automatically to supply air to right and left, and may also stop swinging to supply air to left or right in a fixed manner. The vertical wind direction guide plates 111 may swing up and down automatically to supply air upwards and downwards, and may also stop swinging to supply air upwards and downwards in a fixed manner. With the vertical wind direction guide plates 111 and the horizontal wind direction guide plates 112, the air refrigerated or heated by the semiconductor refrigeration assembly 20 may reach each corner of a room.

A dust separating screen 121, a HEPA (high efficiency particulate air) filter screen 122 and an activated carbon filter screen 123 are mounted in turn from outside to inside at each air inlet 12.

The dust separating screen 121 covers the entire outer end of the air inlet 12. The activated carbon filter screen 123 is aligned with the HEPA filter screen 122. The dust separating screen 121 filters out large dust particles in the incoming air, the HEPA filter screen 122 filters out impurities in the incoming air, such as dust, bacteria, viruses, pollen and allergens, and the activated carbon filter screen 123 further removes peculiar smells in the incoming air. Air may be optimized by utilizing the dust separating screen 121, the HEPA filter screen 122, and the activated carbon filter screen 123, so that the air conditioner has the functions of an air freshener.

A movable door 124 is also set at each air inlet 12. The movable door 124 is located on one side of the HEPA filter screen 122, and its opening or closing may be controlled by a mechanical or electromagnetic force. When a larger air supply is needed, the door may be opened to suck in more air so that the air directly enters the body 10 without flowing through the HEPA filter screen 122 and the activated carbon filter screen 123, thereby increasing the air intake amount and enhancing the refrigeration or heating effect. When the movable door 124 is opened, the dust separating screen 121 may protect the HEPA filter screen 122, the activated carbon filter screen 123 and the movable door 124.

The air conditioner of the present invention also comprises a set of first temperature and humidity sensors 62 mounted in the body 10, and two sets of second temperature and humidity sensors 66 mounted on two sides in the body 10. The first temperature and humidity sensors 62 are located between the horizontal wind direction guide plates 112 and the metallic conductive sheets 30 to detect the temperature and humidity of the air at the air outlet 11 and provide data for a control assembly of the air conditioner, so that the control assembly makes a proper adjustment to the refrigeration or heating data of the semiconductor refrigeration assembly 20 to ensure that the conditions of refrigerated or heated air are in a range that human bodies feel comfortable. The two sets of second temperature and humidity sensors 66 are located between the fan blade 65 and the activated carbon filter screen 123 on the corresponding side to detect the temperature and humidity of the air at the air inlet 12 and provide data for the control assembly of the air conditioner, so that the control assembly makes a proper adjustment to the refrigeration or heating data of the semiconductor refrigeration assembly 20 to ensure that the conditions of refrigerated or heated air are in a range that human bodies feel comfortable. The control assembly is intended for controlling the operation of various components of the air conditioner.

The air conditioner also comprises a plasma releaser 63 and an ultrasonic moisture releasing device 64 mounted in the body 10. Both the plasma releaser 63 and the ultrasonic moisture releasing device 64 are close to backs of the metallic conductive sheets 30, that is, between the metallic conductive sheets 30 and the fan blades 65. The ultrasonic moisture releasing device 64 is connected with the water pump assembly through a connection pipe 641. The plasma releaser 63 is intended to generate cations and anions, so that the fan blades 65 expel the cations and the anions generated by the plasma releaser 63 into the room during refrigeration or heating of the air conditioner, thereby disinfecting and sterilizing the indoor air, further enhancing the function of air freshening, as a result, ensuring that human bodies are in a clean and hygienic environment. The ultrasonic moisture releasing device 64 is intended to increase the humidity in the room when the indoor air is relatively dry. In specific operations, the cooling water, under the action of the water pump 51, flows from the water tank 50 into the ultrasonic moisture releasing device 64 through the connection pipe 641, the ultrasonic moisture releasing device 64 nebulizes the water in it, and the nebulized water is expelled together with the air into the room under the action of the fan blades 65, thereby increasing the humidity in the room.

The refrigeration principle of the present invention is as follows: the fan blades 65 suck in indoor air through the air inlets 12, the semiconductor refrigeration assembly 20 refrigerates the sucked-in air, and the metallic conductive sheets 30 increase the contact area with the air flowing through them to enhance the refrigeration effect, and the refrigerated air is expelled through the air outlet 11 into the room under the action of the fan blades 65, thereby achieving heat exchange and cooling effect of the room. The moisture in the air condenses on the metallic conductive sheets 30, and the condensed water flows into the dew receptacle 40 under gravity and enters the water tank 50 through the return pipe 41. The semiconductor refrigeration assembly 20 dissipates heat through the heat dissipation assembly 64 connected with the semiconductor refrigeration assembly. The water pump assembly pumps the cooling water from the water tank 50 into the cooling water receptacle 60 to achieve cooling and heat dissipation of the heat dissipation assembly 61, which saves the need to dissipate heat outdoors and does not cause the outdoor air temperature to rise. The first temperature and humidity sensors 62 and the second temperature and humidity sensors 66 may detect the temperature and humidity of the air at the air outlet 11 and the air inlets 12 respectively so as to adjust the air temperature and humidity in the room to a range that human bodies feel comfortable. In refrigeration operations, the plasma releaser 63 and/or the ultrasonic moisture releasing device 64 may also be started up to disinfect and sterilize the air in the room and/or increase the humidity in the room. As described above, the present invention can achieve multiple uses and has the functions of a fan, a refrigerator, a heater, a dehumidifier, an air freshener, and a moisture releasing device.

The heating effect of the present invention can be achieved by simply reversing the current of the semiconductor refrigeration assembly 20.

Figure 4:
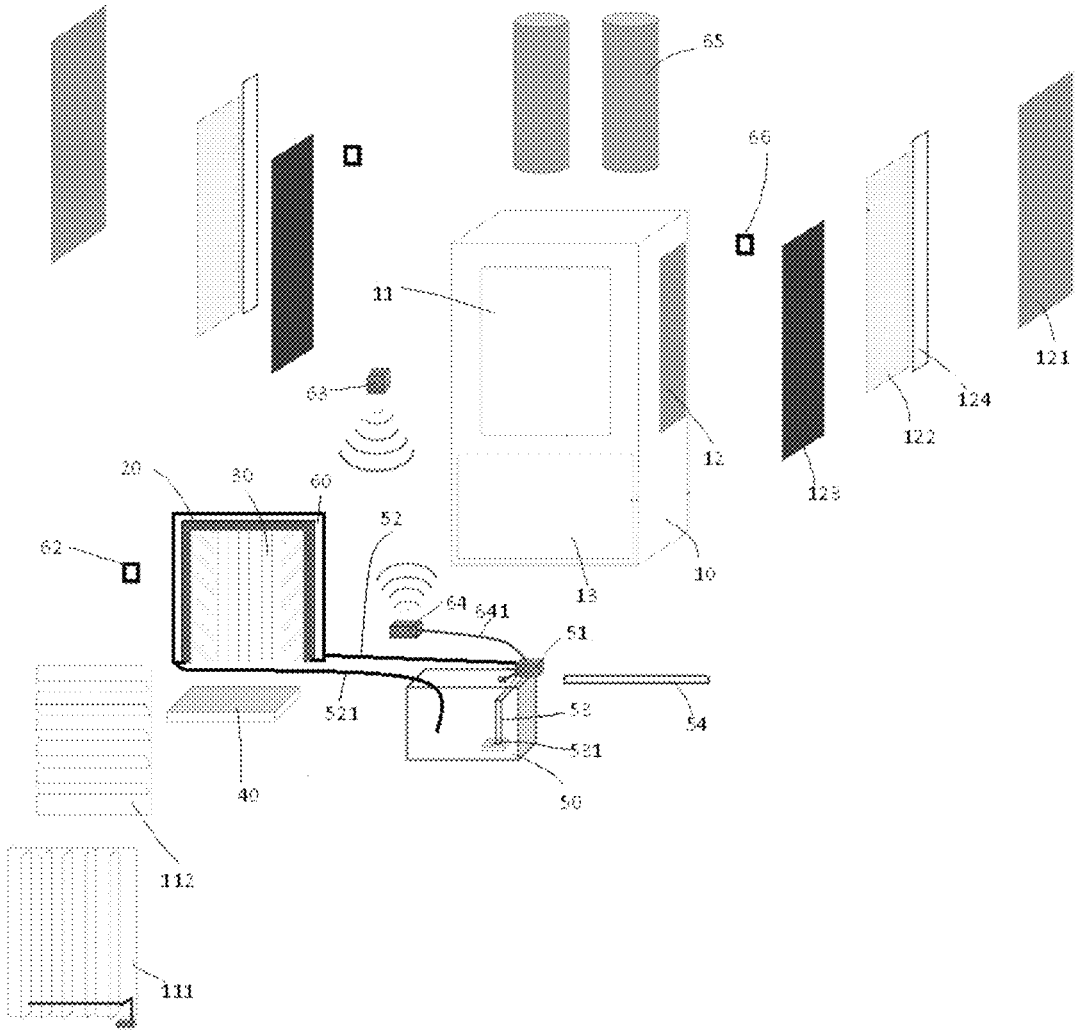
FIG. 4 is a schematic exploded view of a semiconductor refrigeration and heating air conditioner in another embodiment of the present invention.

In another embodiment, as shown in FIG. 4, a semiconductor refrigeration and heating air conditioner of the present invention comprises a body 10, a semiconductor refrigeration assembly 20, metallic conductive sheets 30 connected to the semiconductor refrigeration assembly 20, a dew receptacle 40 mounted under the metallic conductive sheets 30, a water tank 50, a cooling water receptacle 60 surrounding the semiconductor refrigeration assembly 20 and mounted to the heat generation end of the semiconductor refrigeration assembly 20, and two fan blades 65. The case of the cooling water receptacle 60 is made of metal and attached to the heat generation end of the semiconductor refrigeration assembly 20. The metal case of the cooling water receptacle 60 is in direct contact with the heat generation end of the semiconductor refrigeration assembly 20, so that the heat of the semiconductor refrigeration assembly 20 can be transferred directly and rapidly to the cooling water receptacle 60. The water tank 50 is connected with the cooling water receptacle 60 through a water pump assembly. The water pump assembly comprises a pump 51 mounted at the top of the water tank 50, a first pipe 53 and second pipes 52, 521 connected with the pump 51. The first pipe 53 is located in the water tank 50, and the second pipes 52, 521 are connected with the cooling water receptacle 60. The cooling water in the water tank 50 flows into the cooling water receptacle 60 through the first pipe 53 and the second pipe 52 under the action of the water pump 51, thereby rapidly removing the heat transferred to the cooling water receptacle 60. After heat exchange, the water flows back into the water tank 50 through the second pipe 521 under the action of the pump 51. In this embodiment, the main difference lies in the installation method of the cooling water receptacle 60, and other structures are the same as those of the previous embodiments.

The foregoing embodiments are only the preferred embodiments of the present invention, and the description thereof is specific and detailed, but should not be construed as limitations to the scope of the present invention. It should be noted that those skilled in the art may make a number of variations and modifications without departing from the concept of the present invention, such as combination of different features in various embodiments, which fall in the protection scope of the present invention.

What is claimed is:

1. A non-split semiconductor-based air conditioning apparatus comprising:

a body providing an air inlet and an air outlet;

a semiconductor refrigeration assembly mounted within the body, locating at the air outlet;

one or more metallic conductive sheets connecting to the semiconductor refrigeration assembly and facing the air outlet;

a water tank mounted within the body, containing cooling water for absorbing heat generated by the semiconductor refrigeration assembly;

a cooling water receptacle mounted within the body, the cooling water circulating within the body between the cooling water receptacle and the water tank by a pump;

a heat dissipation assembly provided in the cooling water receptacle and surrounded by the cooling water, the heat dissipation assembly being connected to the semiconductor refrigeration assembly through a connection wire; and a plurality of fan blades mounted within the body for sucking in air through the air inlet and expelling the air out through the air outlet;

wherein the semiconductor refrigeration assembly comprises a plurality of semiconductor refrigeration elements mounted upstream the air outlet, with the one or more metallic conductive sheets surrounded by the plurality of semiconductor refrigeration elements, during cooling operation, the heat generated by the semiconductor refrigeration assembly is absorbed by the cooling water from the heat dissipation assembly, wherein the apparatus is adapted for retaining the heat within the body by means of accumulation of the heat in the cooling water in the water tank, and does not actively expel the heat to outside the body.

2. A non-split semiconductor-based air conditioning apparatus comprising:

a body providing an air inlet and an air outlet;

a semiconductor refrigeration assembly mounted within the body, locating at the air outlet;

one or more metallic conductive sheets connecting to the semiconductor refrigeration assembly and facing the air outlet;

a water tank mounted within the body, containing cooling water for absorbing heat generated by the semiconductor refrigeration assembly;

a cooling water receptacle mounted to a heat generation end of the semiconductor refrigeration assembly, the cooling water receptacle surrounding the semiconductor refrigeration assembly, with the cooling water circulating within the body between the cooling water receptacle and the water tank by a pump;

a plurality of fan blades mounted within the body for sucking in air through the air inlet and expelling the air out through the air outlet;

wherein the semiconductor refrigeration assembly comprises a plurality of semiconductor refrigeration elements mounted upstream the air outlet, with the one or more metallic conductive sheets surrounded by the plurality of semiconductor refrigeration elements, during cooling operation, the heat generated by the semiconductor refrigeration assembly is absorbed by the cooling water, wherein the apparatus is adapted for retaining the heat within the body by means of accumulation of the heat in the cooling water in the water tank, and does not actively expel the heat to outside the body.

3. The apparatus of claim 1, wherein one or more vertical wind direction guide plates and horizontal wind direction guide plates are mounted in turn from outside to inside at the air outlet.

4. The apparatus of claim 3, further comprising a set of first temperature and humidity sensors mounted in the body, wherein the first temperature and humidity sensors are located between the horizontal wind direction guide plates and the metallic conductive sheets.

5. The apparatus of claim 1, wherein the air outlet is made in the front of the body, there are two air inlets which are made in two sides of the body respectively, and there are two fan blades which are mounted on two sides in the body respectively, wherein each fan blade faces one air inlet.

6. The apparatus of claim 5, wherein a dust separating screen, a HEPA (high efficiency particulate air) filter screen and an activated carbon filter screen are mounted in turn from outside to inside at each air inlet, the dust separating screen covers the entire outer end of the air inlet, and the activated carbon filter screen is aligned with the HEPA filter screen.

7. The apparatus of claim 6, wherein a second movable door is set at each air inlet, and the second movable door is located on one side of the HEPA filter screen.

8. The apparatus of claim 7, further comprising two sets of second temperature and humidity sensors mounted on two sides in the body, wherein the two sets of second temperature and humidity sensors are located between the fan blade and the activated carbon filter screen on the corresponding side.

9. The apparatus of claim 1, further comprising a dew receptacle mounted under the metallic conductive sheets, wherein the dew receptacle is connected with the water tank through a return pipe.

10. The apparatus of claim 1, wherein the plurality of semiconductor refrigeration elements is mounted at the upper end of the air outlet and on two sides of the air outlet, and the metallic conductive sheets are located in a space surrounded by the plurality of semiconductor refrigeration elements and are connected with the plurality of semiconductor refrigeration elements respectively.

11. The apparatus of claim 2, wherein the cooling water receptacle comprises a case made of metal, and the case is in direct contact with the heat generation end of the semiconductor refrigeration assembly.

12. The apparatus of claim 2, wherein vertical wind direction guide plates and horizontal wind direction guide plates are mounted in turn from outside to inside at the air outlet.

13. The apparatus of claim 12, further comprising a set of first temperature and humidity sensors mounted in the body, wherein the first temperature and humidity sensors are located between the horizontal wind direction guide plates and the metallic conductive sheets.

14. The apparatus of claim 2, further comprising a plasma releaser and an ultrasonic moisture releasing device, wherein the plasma releaser and the ultrasonic moisture releasing device are mounted in the body and close to backs of the metallic conductive sheets, and the ultrasonic moisture releasing device is connected with the water pump assembly through a connection pipe.

15. The apparatus of claim 2, wherein the air outlet is made in the front of the body, there are two air inlets which are made in two sides of the body respectively, and there are two fan blades which are mounted on two sides in the body respectively, wherein each fan blade faces one air inlet.

16. The apparatus of claim 15, wherein a dust separating screen, a HEPA (high efficiency particulate air) filter screen and an activated carbon filter screen are mounted in turn from outside to inside at each air inlet, the dust separating screen covers the entire outer end of the air inlet, and the activated carbon filter screen is aligned with the HEPA filter screen.

17. The apparatus of claim 16, wherein a second movable door is set at each air inlet, and the second movable door is located on one side of the HEPA filter screen.

18. The apparatus of claim 17, further comprising two sets of second temperature and humidity sensors mounted on two sides in the body, wherein the two sets of second temperature and humidity sensors are located between the fan blade and the activated carbon filter screen on the corresponding side.

19. The apparatus of claim 2, wherein the plurality of semiconductor refrigeration elements is mounted at the upper end of the air outlet and on two sides of the air outlet, and the metallic conductive sheets are located in a space surrounded by the plurality of semiconductor refrigeration elements and are connected with the plurality of semiconductor refrigeration elements respectively.

20. A semiconductor refrigeration and heating air conditioner, comprising:

a unitary body providing an air outlet and air inlets;

a semiconductor refrigeration assembly mounted in the body and located at the air outlet;

one or more metallic conductive sheets connected with the semiconductor refrigeration assembly;

a water tank mounted at the lower end inside the body;

a first movable door provided at the lower end of the body adjacent to the water tank;

a cooling water receptacle mounted at the lower end inside the body;

a heat dissipation assembly mounted in the cooling water receptacle; and a plurality of fan blades mounted in the body and adjacent to the air inlets;

wherein the semiconductor refrigeration assembly is connected with the heat dissipation assembly through a connection wire, the water tank is connected with the cooling water receptacle through a water pump assembly, the semiconductor refrigeration assembly comprises a plasma releaser and an ultrasonic moisture releasing device, wherein the plasma releaser and the ultrasonic moisture releasing device are mounted in the body and adjacent to backs of the metallic conductive sheets, and the ultrasonic moisture releasing device is connected with the water pump assembly through a connection pipe.

* * * * *